United States Patent [19]

Pasic

[11] 4,201,127

[45] May 6, 1980

[54] HOLD-DOWN ACCELERATION DEVICE

[75] Inventor: James A. Pasic, Montesano, Wash.

[73] Assignee: Ovalstrapping, Inc., Hoquiam, Wash.

[21] Appl. No.: 908,814

[22] Filed: May 24, 1978

[51] Int. Cl.[2] ..... B65B 13/20

[52] U.S. Cl. ..... 100/7; 100/3; 100/26; 100/278; 100/295; 198/836

[58] Field of Search ..... 100/3, 7, 278, 270, 100/153, 25, 26, 177, 178, 222, 295, 269 R; 198/836

[56] References Cited

U.S. PATENT DOCUMENTS

| | | | |
|---|---|---|---|
| 1,920,539 | 8/1933 | White | 100/153 X |
| 3,198,105 | 8/1965 | Smith | 100/3 |
| 3,348,473 | 10/1967 | Luy | 100/7 |

*Primary Examiner*—Billy J. Wilhite

*Attorney, Agent, or Firm*—Seed, Berry, Vernon & Baynham

[57] ABSTRACT

A hold-down beam is provided on a rapid acceleration conveyor to hold articles, such as an unstable stack of newspapers, tightly against the conveyor for providing frictional engagement between the stack and the conveyor and move the upper part of the stack with the conveyor so that the stack will not topple. The hold-down bar is unpowered, that is, it is mounted for reciprocation in low-friction bearings so that its own frictional engagement with the top of the stack carries it along with the top of the stack until the stack is brought up to the desired velocity. A unique cable system for lowering both ends of a hold-down bar synchronously through an infinite number of positions and does not interfere with operation of a strapping machine.

10 Claims, 5 Drawing Figures

FIG. 2
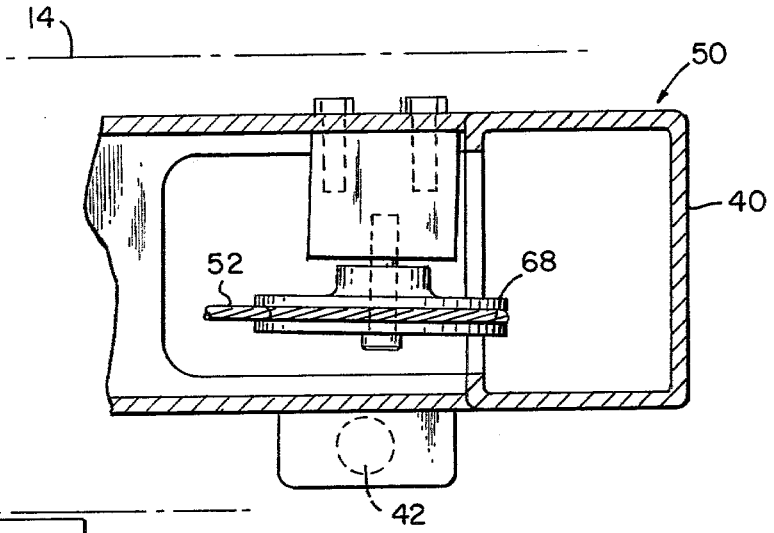
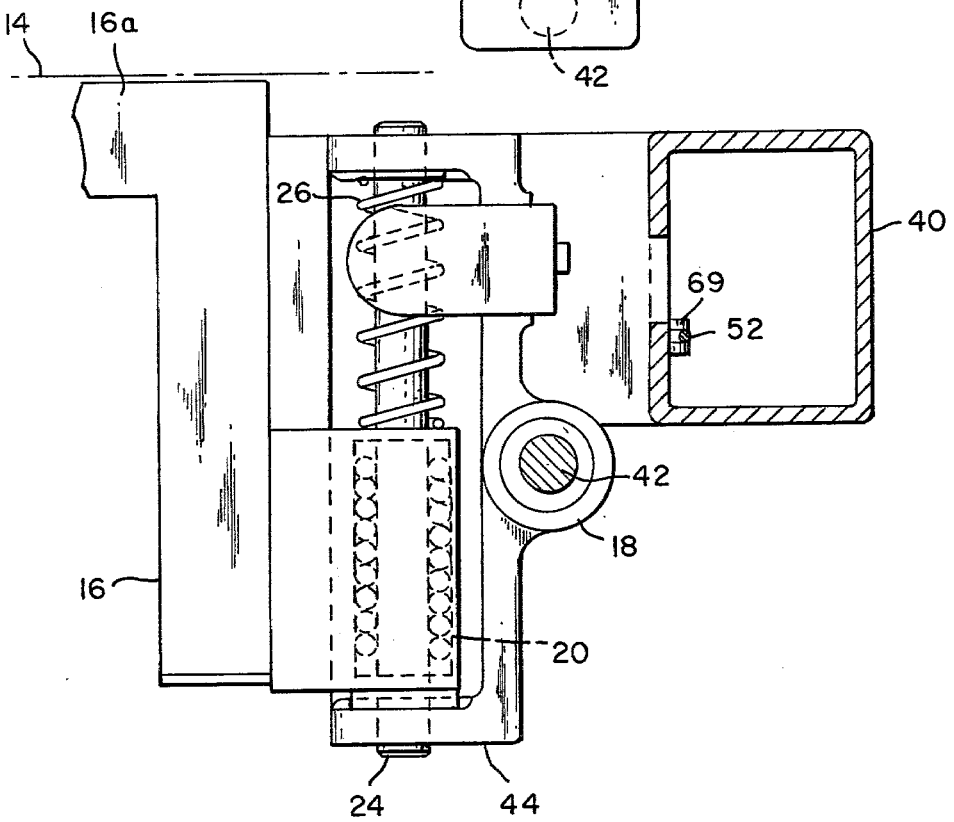
FIG. 3

HOLD-DOWN ACCELERATION DEVICE

BACKGROUND OF THE INVENTION

1. Field of the Invention

This invention pertains to high-speed conveyors, and more particularly, to conveyors of the type used in conjunction with a strapping machine especially where the strapping machine is strapping unstable articles such as stacks of newspaper and compacting the stacks at a strapping location on the strapping machine.

2. Description of the Prior Art

Strapping machines heretofore known have been unable to move stacks of paper through the strapping station of the machine at very high speeds. One of the reasons is the fact that the stack of newspapers is very unstable requiring that it be accelerated and decelerated slowly. One attempt to provide more stability to the stack has been to place a spring biased wheel on the top of the stack to hold the stack tightly against the lower conveying surface. Another technique has been to place a second conveyor on the top of the stack and to attempt to drive both of the conveyors synchronously at the same acceleration rates. Neither of these techniques has proven successful.

Another difficulty with strapping machines is that the compactor beam for compressing the stack has always been a cumbersome mechanism requiring either long stroke cylinders sticking up above the conveyor or extending down into the strapping mechanism below the conveyor in order to provide sufficient stroke to move the compacting beam all the way to the surface of the conveyor as is necessary where only a few papers exist in the stack. Furthermore, these cylinders frequently get out of synchronism with one another such that the compactor beam ends will not come down synchronously and an improper compaction occurs.

SUMMARY OF THE INVENTION

It is an object of one feature of this invention to provide a unique accelerating hold-down device which enables the stack to be accelerated at a high rate without becoming unstable.

It is another object of this invention to provide an inexpensive and simple accelerating hold-down device.

As to the second feature of the invention, it is an object to provide an inexpensive and simple-to-operate cable system for synchronously raising and lowering the opposite ends of the compactor beam of a strapping machine.

BRIEF DESCRIPTION OF THE FIGURES OF THE DRAWINGS

FIG. 2 is a fragmentary horizontal section taken along the line 2—2 of FIG. 1.

FIG. 3 is a fragmentary horizontal section taken along the line 3—3 of FIG. 1.

DETAILED DESCRIPTION OF THE PREFERRED EMBODIMENTS

Figure 1:
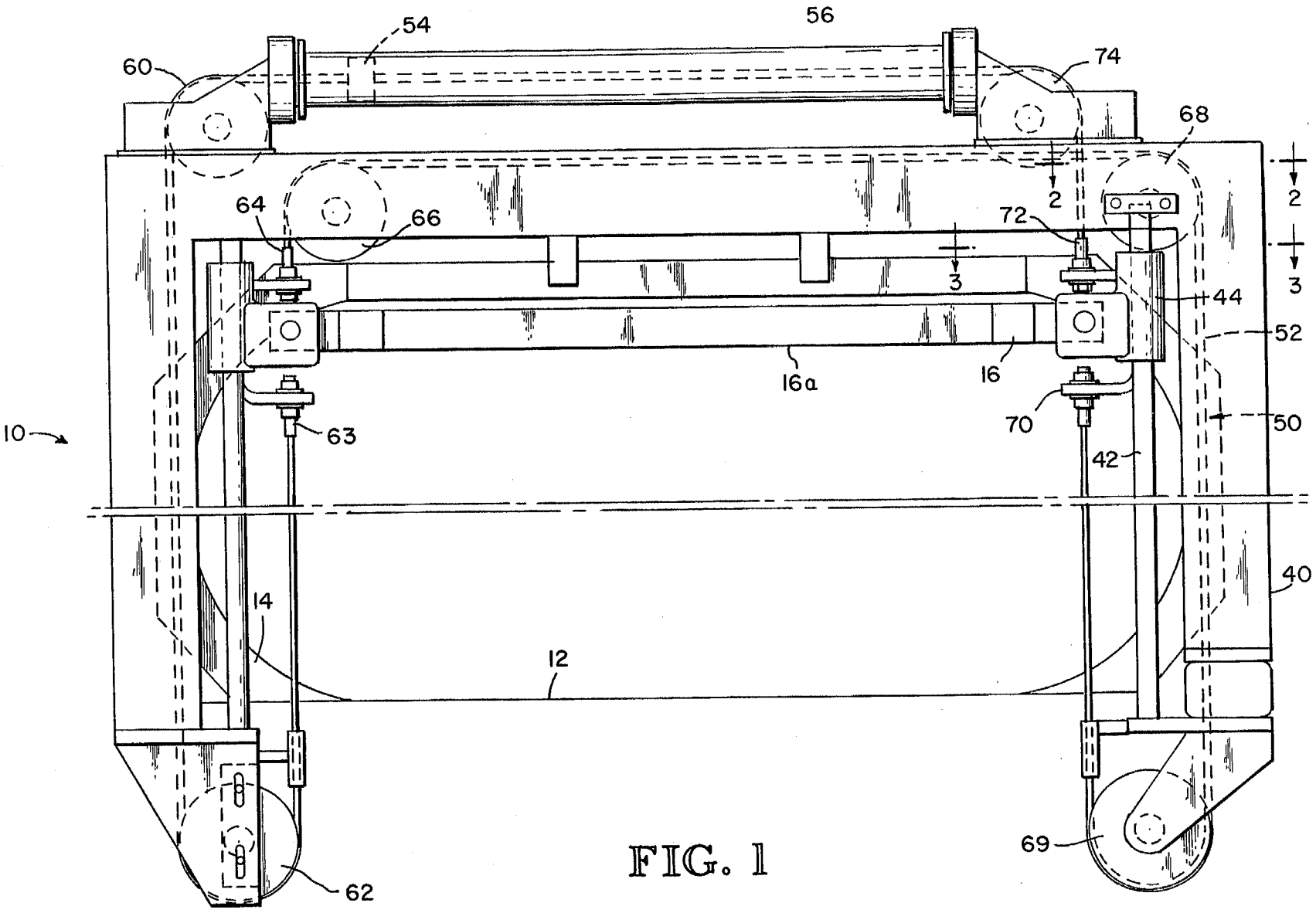
FIG. 1 is a fragmentary front elevation looking into the strapping machine in the direction of conveyor movement into the strapping station.

As best shown in FIG. 1, a strapping machine is provided with an arch 10 which encircles a strapping station above a conventional conveyor 12 of the strapping machine. The conveyor preferably is in two synchronously driven pairs broken in the center to allow passage of the strap. As is well understood, the strapping station is surrounded by a strap track shown partially as 14. Strap is encircled around the object or stack of papers through the strap track at the strapping station and when the strap is then pulled or tensioned tight, it leaves the strap track in a loop closing completely around the stack and is then sealed.

Positioned above the conveyor is a compactor beam 16 which is carried in a frame 18. The frame 18 can be lowered and raised to compact the stack resting on the conveyor and preferably can be lowered all the way to the conveyor surface for handling any size stack. In general, the beam is lowered onto the stack and compresses the stack as the strap is tensioned around the stack. Once the strap is sealed, the conveyor is accelerated to remove the stack from the strapping station to be replaced by a new stack. It is during this period of rapid acceleration necessary for a high production machine that the stack is unstable. It is thus a unique feature of this invention that compactor beam 16 is mounted to the frame via linear ball bearings 20 which ride on a shaft 24. This allows the compactor to continue to press the stack against the conveyor during the acceleration since the compactor is free to follow the stack for a short distance. The ball bearings have very low friction so that the comapctor beam provides essentially only a minimal amount of drag on the top of the stack but rather is carried along with the stack. The compactor pressing the stack against the conveyor assures a fast start since slippage between the conveyor and the stack is minimized. Compression springs 26 return the beam to its "home" position over the strapping station after the compactorbeam is lifted off the stack. With this acceleration device, speeds of up to 40 bundles per minute can be passed through the strapping machine. Usually it takes about 0.04 seconds of travel to get a stack up to its maximum velocity. This occurs in about 1 or 1½ inches of movement of the compactor beam in the direction of conveyor movement. The shaft 24 provides for about three inches of movement so that the compactor beam has ample excess play to accommodate variations in speed, bundle size and the like.

Figure 4:
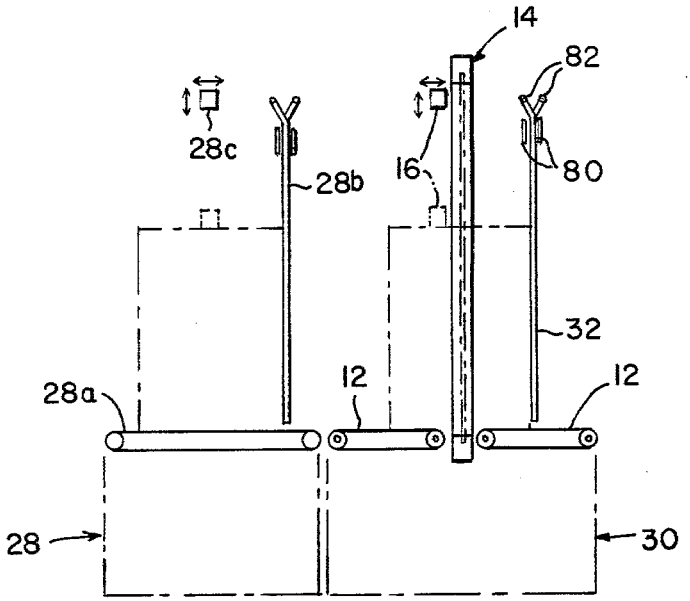
FIG. 4 is a schematic illustration of a side elevation of a strapping machine preceded by an accelerating stack feeding unit.
Figure 5:
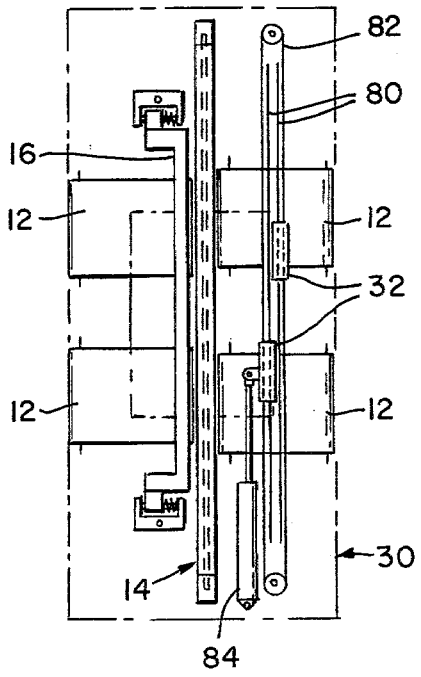
FIG. 5 is a schematic plan illustrating the arrangment of conveyors and stops for locating a stack at a strapping station.

As best shown in FIG. 4, speeds of up to 60 bundles per minute can be achieved by placing an accelerating unit 28 ahead of the strapping unit 30 with the accelerating unit having its own conveyor **28*a*, stops 28*b* and its compacting accelerator hold-down bar 28*c*. The strapping machine 30, of course, has its own conveyor 12, strap back 14, hold-down accelerator bar 16 and stops 32**.

In operation of the combined unit, the stops **28*b* are positioned in front of the on-coming bundle or stack and the bundle is carried very rapidly by the conveyor 28*a*. As the bundle approaches the stop 28*b* it passes a conventional switch and conventional photocell which de-energizes the conveyor 28*a* allowing the bundle to decelerate and eventually hit the stops 28*b*. The accelerator hold-down bar 28*c* is lowered onto the bundle and the stops 28*b* are removed. When the strapping machine is clear, the conveyor is accelerated to rapidly feed a bundle into the strapping station at the strapping machine 30. Again, the conveyor 12 picks up this rapidly moving bundle and, after a short movement, passes another conventional switch and conventional photocell sensor to de-energize the conveyor 12 allowing the bundle to decelerate and finally come to rest against the stops 32. Next the top compactor bar 16 comes down compressing the stack, the strap is applied next to the compactor and while the strap is being applied, the stops 32 are opened. Next the conveyor is accelerated with the compactor bar still down and after approximately 0.04 seconds, the top compactor is raised but during this period has moved with the conveyor until it is almost at full speed. After the bundle clears the stops, the stops are closed again. As the comparator bar is raised, it is pushed back to its home position adjacent the strap track by the springs 26. The conveyors when de-energized will stop with the bundle coasting into the bundle stops. As can be readily seen with or without the addition of the accelerating section 28**, the hold-down bar enables very rapid accelerations of the bundles.

The bundle stops 32 preferably are mounted for horizontal reciprocation in guides 80 and are coupled to opposite runs of an endless overhead cable 82. A cylinder and piston 84 is coupled to one of the stops and by movement of this one stop both stops separate or come together synchronously.

The details of the compactor bar will now be described, these details being applicable to the separate accelerator section 28 also. The arch 10 comprises a generally rectangular inverted U-shaped frame 40 which supports a pair of bars 42 vertically arranged on opposite sides of the strapping station. The bars slidably carry brackets 44 which support the shaft 24. Mounted on the shaft 24 is the slidable bearing unit 20 to which is secured the compactor bar 16 having a jog or main bar portion **16*a* that is positioned closely adjacent the strap track 14**.

It is a unique feature of this invention also that the compactor bar opposite ends can be lowered and raised synchronously by a cable system 50. The cable system includes a cable 52 having one end attached to a piston 54 in a pneumatic cylinder 56. The pneumatic cylinder is arranged at a convenient location above the strapping station in a horizontal arrangement as shown. This is important in a strapping machine since the area beneath the strapping station is filled with mechanisms for controlling and tensioning the strap and frequently the space above the strapping machine does not provide for much vertical head room or height. The cable leaving the left hand side of the piston 54, as shown in FIG. 1, travels around an upper first sheave 60 down to a lower second sheave 62 and then up to be dead ended or connected as at 63 to one of the ends of the compactor bar. The cable is then again connected as at 64 above the comparator bar travels about an upper third sheave 66 and across over the strapping station to an upper fourth sheave 68. The cable travels around the fourth sheave to a lower fifth sheave 69 and then up to be again connected to the opposite end of the compactor bar as at 70. The cable then is connected again at the upper end of the compactor bar as at 72 passes around an upper sixth sheave 74 and thence back to the opposite side of the piston 54. As can be readily seen as the piston is stroked to the right the cable at 63 and the cable at 70 will be pulling down synchronously on opposite ends of the compactor bar. When the piston is moved to the left, the opposite ends of the compactor bar are raised synchronously.

While the preferred embodiments of the invention have been illustrated and described, it should be understood that variations will be apparent to one skilled in the art without departing from the principles herein. Accordingly, the invention is not to be limited to the specific embodiment illustrated in the drawing.

I claim:

1. Apparatus for compacting and accelerating an article comprising:

a movable conveyor having a conveying surface, means for accelerating the conveyor, compactor means overlying the conveyor, means for moving the compactor means away from and toward the conveyor surface for positioning the compactor means at a variety of positions remote from and closely adjacent to the conveying surface, and undriven mounting means for mounting the compactor means on said positioning means for allowing free unpowered unrestricted movement over the conveying surface along a path parallel to the conveying surface when the compactor means is in engagement with the article thereby holding the article against the conveying surface and being moved along said path solely by the article.

2. The apparatus of claim 1, said article being a stack and wherein said compactor means includes an elongated bar having lower surface which presses against the top of the stack and thus keeps the stack from toppling.

3. The apparatus of claim 2, including means for returning the elongated bar to its original position after being moved by the stack.

4. The apparatus of claim 3, including stop means for arresting movement of an oncoming stack to stop the stack, said compactor means returning means including a control mechanism for aligning the compacting means relative to said stop means upon return.

5. The apparatus of claim 4, said stop means including a pair of vertical members tranversely spaced, and movable laterally of the conveyor in opposite directions away from each other to open rapidly the space in front of the conveyor surface, said vertical members being slidably mounted on transverse guide bars, a single endless cable having opposite runs each attached to a respective vertical member, and a single actuator coupled to said cable for moving the opposite runs laterally simultaneously in opposite directions for opening and closing said stop means.

6. A compactor accelerator device comprising:

a movable conveyor having a conveying surface, means for accelerating the conveyor, compactor means overlying the conveyor, means for positioning the compactor means at a variety of positions remote from and closely adjacent to the conveying surface, means for mounting the compactor means on said positioning means for free upward movement by an article on the conveying surface along a path parallel to the conveying surface when the compactor means is in engagement with the article thereby holding the article against the conveying surface, said article being a stack and wherein said compactor means presses against the top of the stack and thus keeps the stack from toppling, said compacting means including a bar, said means for mounting the compacting means for free unpowered movement including frame means positioned on opposite lateral sides of said conveying surface and having parallel ways, bearing means on opposite ends of said bar movable in said ways for guiding movement of said bar parallel to said conveying surface.

7. A compactor accelerator device comprising:

a movable conveyor having a conveying surface, means for accelerating the conveyor, compactor means overlying the conveyor, means for positioning the compactor means at a variety of positions remote from and closely adjacent to the conveying surface, and means for mounting the compactor means on said positioning means for free unpowered movement by an article on the conveying surface along a path parallel to the conveying surface when the compactor means is in engagement with the article thereby holding the article against the conveying surface, said means for positioning said compactor means including a cable, actuator means for reciprocating said cable, and sheaves for guiding movement of said cable, said cable starting above said conveying means at one end on said actuator means, down around a sheave below compactor means, up to and connected with a first end of said compactor means, beyond and above said compactor means, over past a second opposite end of said compactor means, down around another sheave and up again to said second opposite end of said compacting means and connected thereto, and then up to said actuator means whereby movement of said actuator means will simultaneously and synchronously lower or raise both said first and second opposite ends of said compacting means.

8. A compactor beam for a strapping machine of the type having a strapping station surrounded by a strapping track from which the strap is encircled about the article to be strapped, comprising:

a conveyor at the strapping station for moving an article beneath the strap track, a compactor beam at the strapping station above the conveyor and lying generally parallel to the strap track for compressing the article when the strap is tightened and secured around the article, and means for moving the compactor beam to the conveyor for compacting various height articles, said comparator beam moving means including a cable and sheave system lying generally above the conveyor and having an actuator for reciprocating the ends of the cable in a horizontal plane, said compactor beam having opposite ends, said cable starting at one end of the actuator and passing downward around an upper first sheave and down around a lower second sheave adjacent the conveyor, up around the second sheave and connected to the compactor beam end, the cable then passing over an upper third sheave across to the opposite end of the compactor beam, around an upper fourth sheave, then down to a lower fifth sheave and up and connected to the opposite beam end, thence up around an upper sixth sheave and to the opposite end of said actuator and wherein reciprocation of the cable ends by the actuator will draw the two ends of the compactor beam down or up synchronously.

9. A strapping machine having a conveyor and hold-down compactor beam above the conveyor, bundle stops ahead of the beam in the direction of travel of the conveyor, and a strapping mechanism for placing a tight loop of strap around the bundle, said strapping mechanism including a strap guide lying in a vertical plane transverse to said conveyor, the improvement comprising a cable system for moving opposite ends of the compactor beam vertically in synchronism, said cable system including a cable, an actuator for reciprocating the cable and means coupling the cable to the compactor beam for moving the ends of the beam in unison in response to movement of the actuator, said cable lying in a single vertical plane closely adjacent the strap guide and also transverse to the conveyor.

10. A compactor accelerator device for compacting and accelerating an article on a conveyor, comprising:

a movable conveyor having a conveying surface, 1 means for accelerating the conveyor, compactor means overlying the conveyor, means for positioning the compactor means at a variety of positions remote from and closely adjacent to the conveying surface, and freely slidable bearing means for supporting the compactor in unpowered, unrestrained movement by the article along a path parallel to the conveying surface when the compactor means is in engagement with the article for increasing the friction force between the article and the conveying surface while allowing the article to move the compactor beam freely therewith while the compactor is pressed against the article in a direction perpendicular to the plane of the conveying surface.

* * * * *